US006359385B1

(12) United States Patent
Denissen et al.

(10) Patent No.: US 6,359,385 B1
(45) Date of Patent: Mar. 19, 2002

(54) LOW-PRESSURE MERCURY VAPOR DISCHARGE LAMP WITH ELECTRODE SHIELD

(75) Inventors: Cornelis J. M. Denissen, Nuth (NL); Cornelis R. Ronda, Aachen (DE); Wilhelmus M. P. Van Kemenade, Maarheeze; Henricus P. M. Gubbels, Eindhoven, both of (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/304,553

(22) Filed: May 4, 1999

(30) Foreign Application Priority Data

May 8, 1998 (EP) ..... 98201548

(51) Int. Cl.[7] ..... H01J 17/06; H01J 61/10

(52) U.S. Cl. ..... 313/613; 313/616; 313/609

(58) Field of Search ..... 313/492, 613, 313/616, 609

(56) References Cited

U.S. PATENT DOCUMENTS 2,946,909 A * 7/1960 Morehead ..... 313/486
2,959,702 A * 11/1960 Beese ..... 313/492
4,032,813 A * 6/1977 Surgan et al. ..... 313/492
5,686,795 A * 11/1997 Sakoske et al. ..... 313/613
6,049,164 A * 4/2000 Van Kemenade et al. .. 313/492

FOREIGN PATENT DOCUMENTS

DE 1060991 7/1959

* cited by examiner

*Primary Examiner*—Michael H. Day
(74) *Attorney, Agent, or Firm*—Dicran Halajian

(57) ABSTRACT

A low-pressure mercury-vapor discharge lamp is provided with a discharge vessel and a first and a second end portion (12*a*). The discharge vessel encloses a discharge space provided with a filling of mercury and an inert gas in a gastight manner. Each end portion (12*a*) supports an electrode (20*a*) arranged in the discharge space. An electrode shield (22*a*) encompasses at least one of the electrodes (20*a*) and is made from a ceramic material. Preferably, the electrode shield (22*a*) is tubular in shape with a lateral slit directed towards the discharge space.

2 Claims, 4 Drawing Sheets

LOW-PRESSURE MERCURY VAPOR DISCHARGE LAMP WITH ELECTRODE SHIELD

BACKGROUND OF THE INVENTION

The invention relates to a low-pressure mercury-vapor discharge lamp comprising a discharge vessel, which discharge vessel encloses a discharge space containing a filling of mercury and an inert gas in a gastight manner, electrodes being arranged in the discharge space for generating and maintaining a discharge in said discharge space, and an electrode shield at least substantially surrounding at least one of the electrodes.

In mercury-vapor discharge lamps, mercury is the primary component for (efficiently) generating ultraviolet (UV) light. An inner surface of the discharge vessel may be provided with a luminescent layer containing a luminescent material (for example a fluorescent powder) for converting UV to other wavelengths, for example to Uv-B and UV-A for tanning purposes (sunbed lamps) or to visible radiation. Such discharge lamps are therefore also referred to as fluorescent lamps.

A low-pressure mercury-vapor discharge lamp of the type mentioned in the opening paragraph is known from DE-A 1 060 991. In said known lamp, the electrode shield surrounding the electrode is made from thin sheet titanium. By using an electrode shield, which is also referred to as anode shield or cathode shield, blackening at an inner surface of the discharge vessel is counteracted. In this respect, titanium serves as the getter for chemically binding oxygen, nitrogen and/or carbon.

A drawback of the use of a metal or metal alloy is that it may cause a short-circuit of the electrode wires. In addition, the metals in the electrode shield may amalgamate with the mercury present in the lamp and, thus, absorb mercury. As a result, the known lamp requires a relatively high dose of mercury to obtain a sufficiently long service life. Injudicious processing of the known lamp after its service life has ended adversely affects the environment.

SUMMARY OF THE INVENTION

It is an object of the invention to provide a low-pressure mercury-vapor discharge lamp, which has a relatively low mercury consumption.

To achieve this, the electrode shield is made from a ceramic material.

For the proper operation of low-pressure mercury-vapor discharge lamps, the electrodes of such discharge lamps include an (emitter) material having a low so-called work function (reduction of the work function voltage) for supplying electrons to the discharge (cathode function) and receiving electrons from the discharge (anode function). Known materials having a low work function are, for example, barium (Ba), strontium (Sr) and calcium (Ca). It has been observed that, during operation of low-pressure mercury-vapor discharge lamps, material (barium and strontium) of the electrode(s) is subject to volatilization. It has been found that, in general, the emitter material is deposited on the inner surface of the discharge vessel. It has further been found that the above-mentioned Ba (and Sr), which is deposited elsewhere in the discharge vessel, no longer participates in the light-generating process. The deposited (emitter) material further forms mercury-containing amalgams on the inner surface, as a result of which the quantity of mercury available for the discharge operation decreases (gradually), which may adversely affect the service life of the lamp. In order to compensate for such a loss of mercury during the service life of the lamp, a relatively high dose of mercury is necessary, which is undesirable from the point of view of environmental protection. The inventors have recognized that the provision of an electrode shield, which surrounds the electrode(s) and is made from a ceramic material, reduces the reactivity of materials in the electrode shield relative to the mercury present in the discharge vessel, leading to the formation of amalgams (Hg—Ba, Hg—Sr). In addition, the use of an electrically insulating material precludes the development of short circuits in the electrode wires and/or in a number of windings of the electrode(s). The known lamp has an electrode shield of an electroconductive material, which, in addition, relatively readily forms an amalgam with mercury. The mercury consumption of the discharge lamp is limited by substantially reducing the degree to which the material of the shield surrounding the electrode(s) reacts with mercury.

The electrode shield itself should not appreciably absorb mercury. To achieve this, the material of the electrode shield includes at least an oxide of at least one element of the series formed by magnesium, aluminum, titanium, zirconium, yttrium and the rare earths. Preferably, the electrode shield is made from a ceramic material which comprises aluminum oxide. Particularly suitable electrode shields are manufactured from so-called densely sintered $Al_2O_3$, also referred to as DGA. An additional advantage of the use of aluminum oxide is that an electrode shield made of such a material is resistant to relatively high temperatures (>250° C.). At such relatively high temperatures, there is an increased risk that the (mechanical) strength of the electrode shield decreases, thus adversely affecting the shape of the electrode shield. If a metal or metal alloy is used as the electrode shield, as is the case in the known discharge lamp, the temperature of the electrode shield must not be too high to prevent that the metal or one of the metals of the metal alloy begins to deform or evaporate, thereby giving rise to undesirable blackening of the inner surface of the discharge vessel. (Emitter) material originating from the electrode(s) and deposited on an electrode shield of aluminum oxide which is at a much higher temperature, cannot or hardly react with the mercury present in the discharge, as result of said high temperature, so that the formation of mercury-containing amalgams is at least substantially precluded. In this manner, the use of an electrode shield in accordance with the invention serves a dual purpose. On the one hand, it is effectively precluded that the material originating from the electrode(s) is deposited on the inner surface of the discharge lamp, and, on the other hand, it is precluded that (emitter) material deposited on the electrode shield forms amalgams with the mercury present in the discharge lamp. Preferably, in operation, the temperature of the electrode shield exceeds 250° C. An advantage of such a relatively high temperature is that, in particular, in the initial stage, the electrode shield becomes hotter than in the known lamp, as a result of which any mercury bound to the electrode shield is released more rapidly and more readily.

An additional advantage of the use of a ceramic electrode shield of aluminium oxide, which surrounds the electrode, is achieved in lamps which are operated on a ballast which can be dimmed, for example a so-called high-frequency regulating (HFR) dimming ballast, in which, particularly at dimmed light intensities, excessive evaporation of electrode-emitter material may occur, said electrode generally being additionally heated under said conditions while using a so-called "bias current". The electrode shield captures this material and effectively precludes the formation of amalgams. As a result, the mercury consumption of the low-pressure mercury-vapor discharge lamp is limited.

The shape of the electrode shield and its position relative to the electrode influence the temperature of the electrode shield. A further embodiment of the low-pressure mercury-vapor discharge lamp in accordance with the invention is characterized in that the electrode shield is tubular in shape. Electrodes in low-pressure mercury-vapor discharge lamp are generally elongated and cylindrically symmetric, for example a coil with windings about a longitudinal axis. A tubularly shaped electrode shield harmonizes very well with such a shape of the electrode. Preferably, an axis of symmetry of the electrode shield extends substantially parallel to, or substantially coincides with, the longitudinal axis of the electrode. In the latter case, the average distance from an inside of the electrode shield to an external dimension of the electrode is at least substantially constant.

A particularly preferred embodiment of the low-pressure mercury-vapor discharge lamp is characterized in accordance with the invention in that an inner circumference d, of the electrode shield meets the relation:

$$1.25\times d_e \leq d_s \leq 2.5\times d_e,$$

where $d_e$ is an outer circumference of the electrode. In said area, the temperature of the electrode shield during operation of the low-pressure mercury-vapor discharge lamp is so high that it is at least substantially precluded that (emitter) material deposited on the electrode shield by evaporation or so-called sputtering from the electrode(s), reacts with the mercury present in the discharge, so as to form amalgams. The lower limit, $1.25\times d_e$, of the inner circumference $d_s$ of the electrode shield ensures that (mechanized) mounting of the electrode shield does not lead to too small an interspace between the electrode shield and the electrode. An inner circumference ds of the electrode shield below $2.5\times d_e$ ensures that, in operation, the temperature of the (emitter) material deposited on the electrode shield is in the desired temperature range to effectively counteract the formation of amalgams.

Preferably, the electrode shield is provided with a slit on a side facing the discharge space. A slit in the electrode shield in the direction of the discharge causes a relatively short discharge path between the electrodes of the low-pressure mercury-vapor discharge lamp. This is favorable for a high efficiency of the lamp. The slit preferably extends parallel to the axis of symmetry of the electrode shield (so-called lateral slit in the electrode shield). In the known lamp, the aperture or slit in the electrode shield faces away from the discharge space. In an alternative embodiment, the electrode shield is tubular in shape and not provided with a slit.

These and other aspects of the invention will be apparent from and elucidated with reference to the embodiments described hereinafter.

BRIEF DESCRIPTION OF THE DRAWINGS

The Figures are purely schematic and not drawn to scale. Particularly for clarity, some dimensions are exaggerated strongly. In the Figures, like reference numerals refer to like parts whenever possible.

DETAILED DESCRIPTION OF THE PREFERRED EMBODIMENTS

Figure 1:
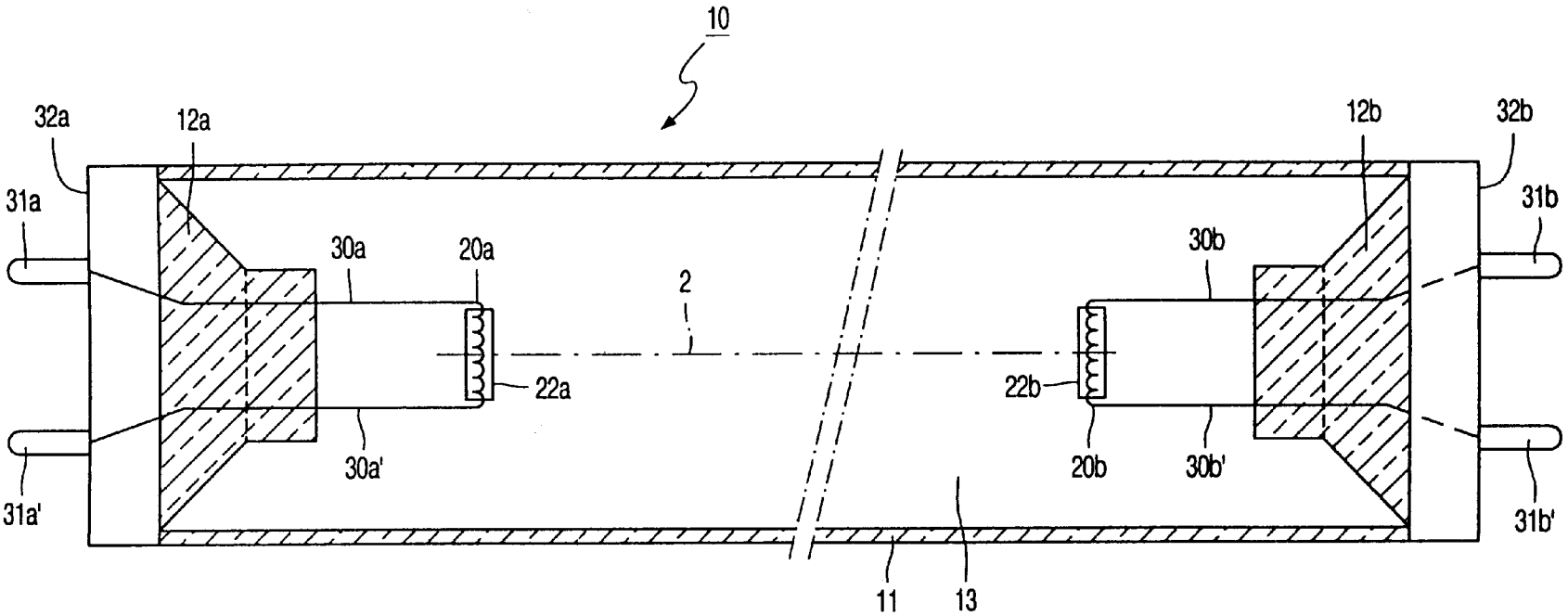
FIG. 1 is a cross-sectional view of an embodiment of the low-pressure mercury-vapor discharge lamp in accordance with the invention in longitudinal section.

FIG. 1 shows a low-pressure mercury-vapor discharge lamp comprising a glass discharge vessel 10 having a tubular portion 11 about a longitudinal axis 2, which discharge vessel transmits radiation generated in the discharge vessel 10 and is provided with a first and a second end portion 12*a*; 12*b*, respectively. In this example, the tubular part 11 has a length of 120 cm and an inside diameter of 24 mm. The discharge vessel 10 encloses, in a gastight manner, a discharge space 13 containing a filling of 1 mg mercury and an inert gas, for example argon. The wall of the tubular part is generally coated with a luminescent layer (not shown in FIG. 1) which includes a luminescent material (for example a fluorescent powder) which converts the ultraviolet (UV) light generated by failback of the excited mercury into (generally) visible light. The end portions 12*a*; 12*b* each support an electrode 20*a*; 20*b* arranged in the discharge space 13. The electrode 20*a*; 20*b* is a winding of tungsten covered with an electron-emitting substance, in this case a mixture of barium oxide, calcium oxide and strontium oxide. The current-supply conductors 30*a*, 30*a*'; 30*b*, 30*b*' of the electrodes 20*a*; 20*b*, respectively, pass through the end portions 12*a*; 12*b* and extend beyond the discharge vessel 10. The current-supply conductors 30*a*, 30*a*'; 30*b*, 30b' are connected to contact pins 31*a*, 31*a*'; 31*b*, 31*b*' which are secured to a lamp cap 32*a*, 32*b*. In general, around each electrode 20*a*; 20*b* an electrode ring is arranged (not shown in FIG. 1) on which a glass capsule for proportioning mercury is clamped. In an alternative embodiment, an amalgam comprising mercury and an alloy of PbBiSn is provided in an exhaust tube which is in communication with the discharge vessel 10.

Figure 2:
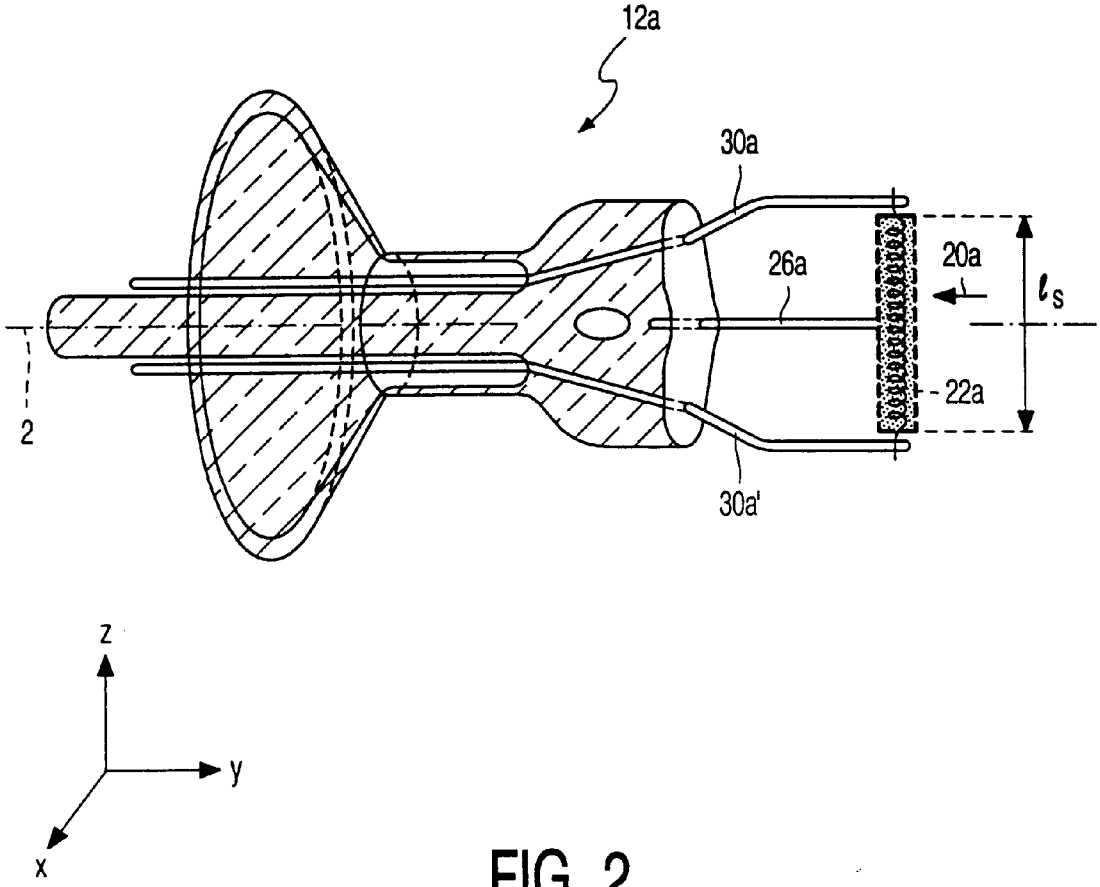
FIG. 2 shows a detail of FIG. 1, which is partly drawn in perspective.
Figure 3A:
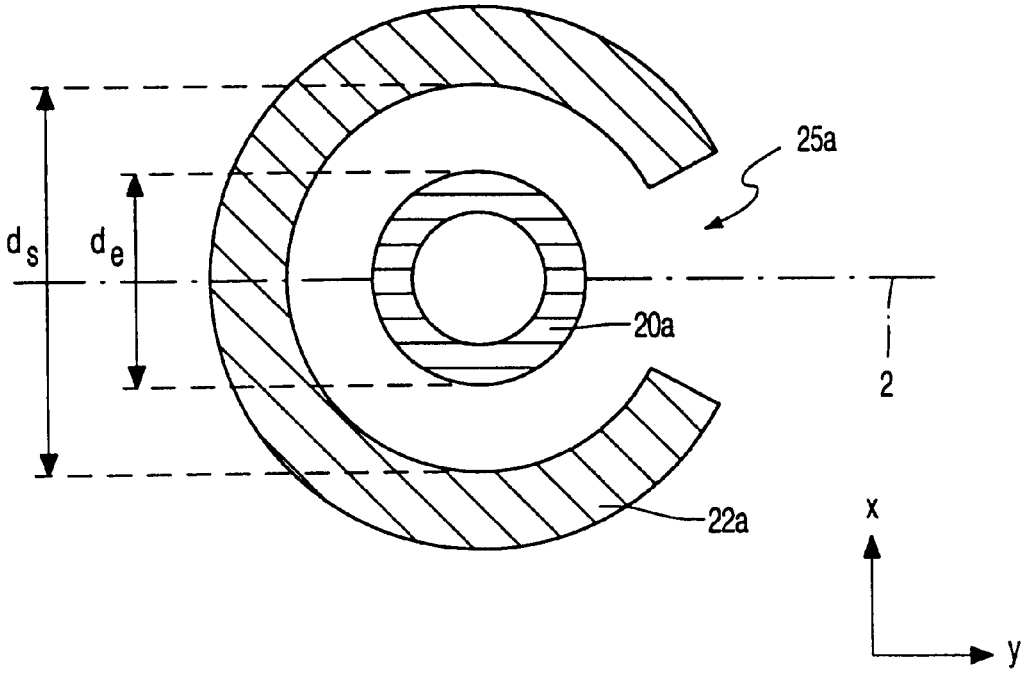
FIG. 3A shows an embodiment of the electrode shield about the electrode as shown in FIG. 2.
Figure 3B:
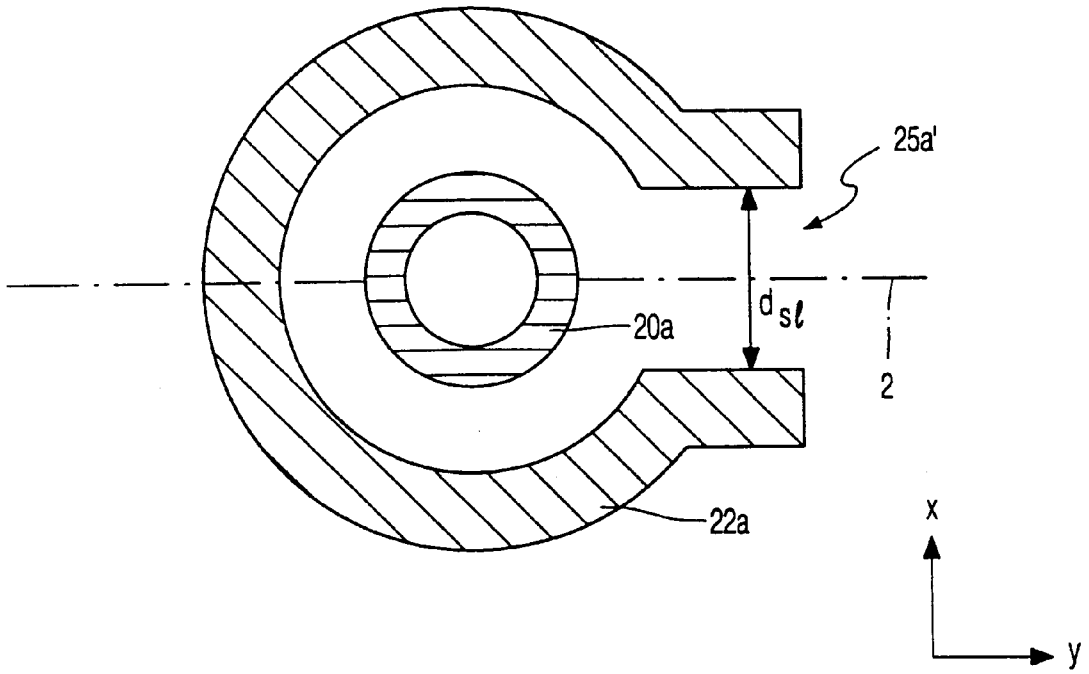
FIG. 3B shows an alternative embodiment of the electrode shield about the electrode as shown in FIG. 3A.

In the example shown in FIG. 1, the electrode 20*a*; 20*b* is surrounded by an electrode shield 22*a*; 22*b* having a length $l_s$, which electrode shield is manufactured, in accordance with the invention, from a ceramic material. FIG. 2 is a partly perspective view of a detail shown in FIG. 1, the end portion 12*a* supporting the electrode 20*a* via the current supply conductors 30*a*, 30*a*'. The electrode 20*a* is surrounded by a tubular electrode shield 22*a*, which is supported by a supporting wire 26*a*, which is provided in the end portion 12*a*. FIGS. 3A and 3B are cross-sectional views of two embodiments of the tubular electrode shield 22*a*. The cross-sectional views shown in FIGS. 3A and 3B are rotated through 90° relative to the longitudinal axis 2 in FIG. 2. The electrode 20*a* is very schematically shown as a part of a winding, said electrode having an outer circumference which is referenced $d_e$. The cylindrically symmetrical electrode shield 22*a* has an inner circumference referenced $d_s$. In an alternative embodiment, the electrode shield may also be of (regular) polygonal shape, for example an at least substantially cubical or hexagonal electrode shield. On the side of the discharge lamp facing the discharge, the electrode shield 22*a* is provided with a lateral slit 25*a*; 25*a*' with an aperture which is referenced $d_{sl}$. In a particularly preferred embodiment, the electrode 20*a* has an outside diameter $d_e$=2 mm, the electrode shield has a length $l_s$=8 mm and an outside diameter $d_s$=3 mm. A suitable outside diameter of the electrode shield is 4 mm. Given the diameter of the electrode, it applies that $d_s=1.5\times d_e$, and the electrode shield meets the relation:

$$1.25\times d_e \leqq d_s \leqq 2.5\times d_e.$$

The electrode shield precludes that (emitter) material originating from the electrode is deposited on the inner wall of the discharge vessel, thereby preventing undesirable blackening. By virtue of the electrode shield in accordance with the invention, the temperature of (emitter) material deposited on the ceramic electrode shield is so high during operation of the low-pressure mercury-vapor discharge lamp that the material cannot form mercury-containing amalgams, so that a considerable reduction in mercury consumption of the lamp is achieved.

Experiments have shown that a low-pressure mercury-vapor discharge lamp provided with a tubular electrode shield made of DGA and provided around the electrode exhibits a mercury consumption in the area of the electrode of less than 2$\mu$g after 100 burning hours on a so-called high-frequency regulating (HFR) dimming ballast, whereas a reference lamp provided with the known electrode shield exhibits a mercury consumption in the area of the electrode of more than 20$\mu$g. After 10,000 burning hours, the reference lamps operated on such a ballast can no longer be started for lack of mercury. Such a service life is substantially shorter than the customary service life of these discharge lamps, which amounts to approximately 17,000 hours. Low-pressure mercury-vapor discharge lamps comprising a ceramic electrode shield surrounding the electrodes meet the prescribed service life specification.

Figure 4:
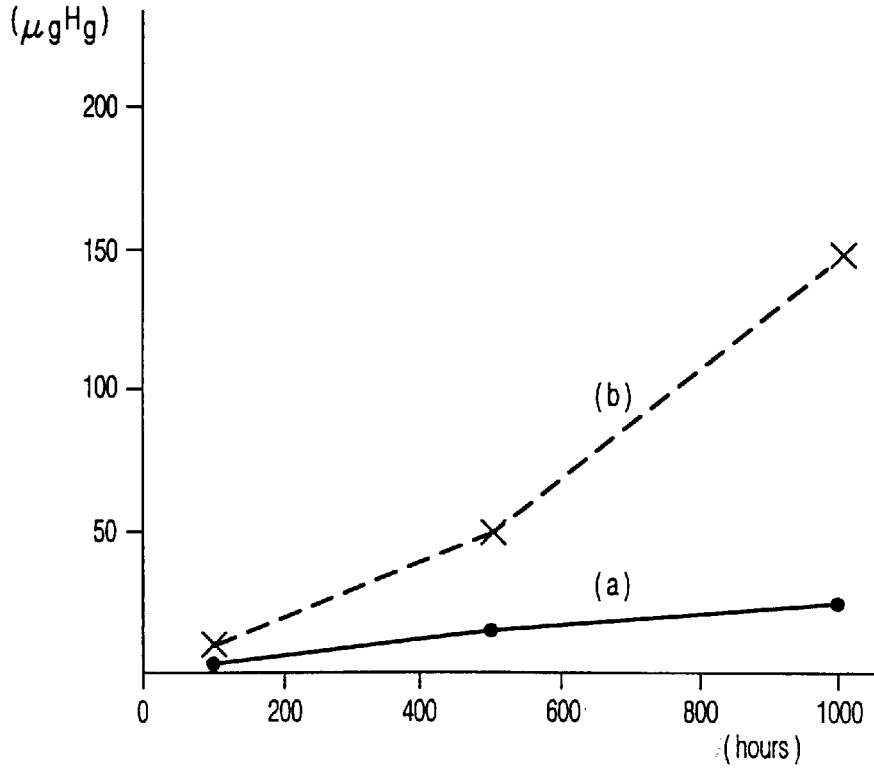
FIG. 4 shows the mercury consumption of a low-pressure mercury-vapor discharge lamp with an electrode shield in accordance with the invention, operated on a cold-start ballast with a short cycle, in comparison with the mercury consumption of a known discharge lamp.
Figure 5:
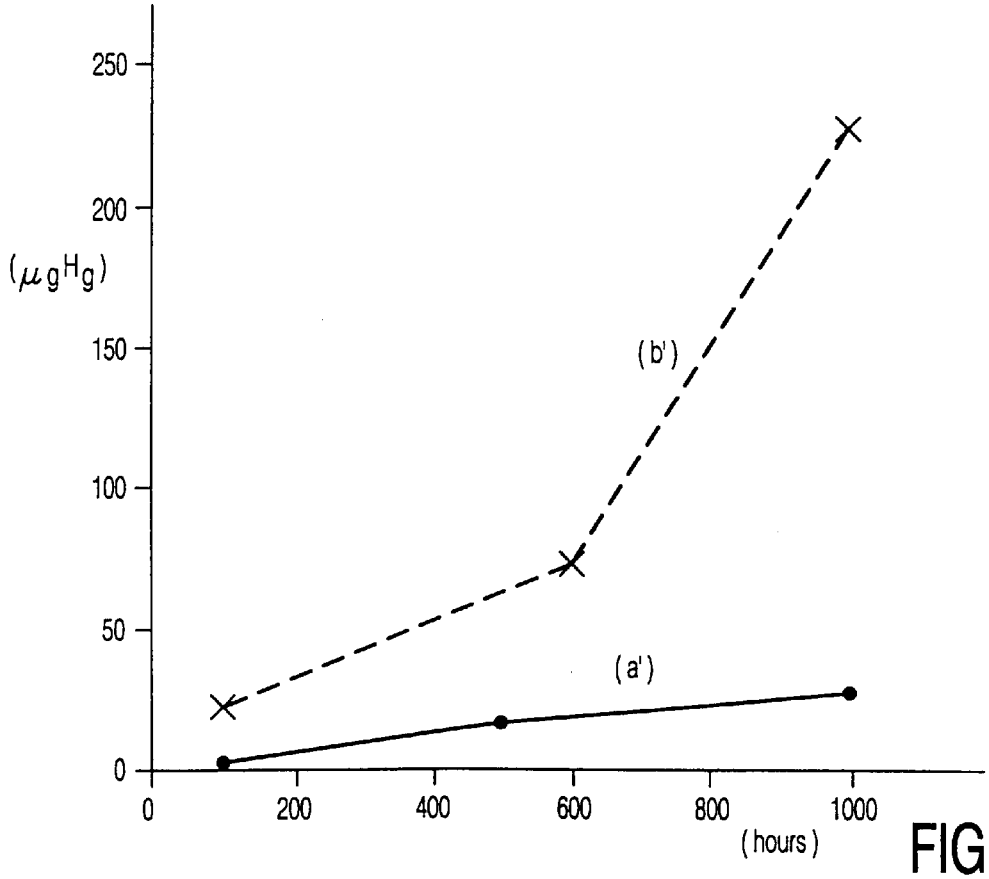
FIG. 5 shows the mercury consumption of a low-pressure mercury-vapor discharge lamp with an electrode shield in accordance with the invention, operated on a dimmed ballast with a long cycle, in comparison with the mercury consumption of a known discharge lamp.

In further experiments, low-pressure mercury-vapor discharge lamps manufactured in accordance with the invention were compared to known discharge lamps. In FIG. 4 the mercury consumption of a low-pressure mercury-vapor discharge lamp comprising an electrode shield in accordance with the invention is compared with the mercury consumption of a known discharge lamp, the discharge lamps being operated on a so-called cold-starting ballast with a short switching cycle in which the lamp, alternately, burns for 15 minutes and is switched off for 5 minutes. After 1000 burning hours, the electrode provided with a tubular DGA electrode shield exhibited a mercury consumption in the area of the electrode of 25$\mu$g (curve a), whereas the known lamp exhibited a mercury consumption in the area of the electrode of 148$\mu$g (curve b). The use of the DGA tube in accordance with the invention causes the mercury consumption in the area of the electrode to be reduced by approximately 70% In FIG. 5, the mercury consumption of a low-pressure mercury-vapor discharge lamp comprising an electrode shield in accordance with the invention is compared with the mercury consumption of a known discharge lamp, the discharge lamps being operated on a dimmed ballast for 1250 hours with a long switching cycle in which the lamps alternately burn for 165 minutes and are switched off for 15 minutes. After 1000 burning hours, the electrode comprising a tubular DGA electrode shield exhibited a mercury consumption in the area of the electrode of 25$\mu$g (curve a'), whereas the known lamp exhibited a mercury consumption in the area of the electrode of 225$\mu$g (curve b'). This comparison shows that the known discharge lamp has a much higher mercury consumption during its service life than the discharge lamp provided with an electrode shield in accordance with the invention.

It will be obvious that within the scope of the invention many variations are possible to those skilled in the art. The discharge vessel does not necessarily have to be elongated and tubular; it may alternatively take different shapes. In particular, the discharge vessel may have a curved shape (for example meander-shaped).

The invention is embodied in each novel characterizing part and each combination of characterizing parts.

What is claimed is:

1. A low-pressure mercury-vapor discharge lamp comprising a discharge vessel, which discharge vessel encloses a discharge space containing a filling of mercury and an inert gas in a gastight manner, electrodes being arranged in the discharge space for generating and maintaining a discharge in said discharge space, and an electrode shield at least substantially surrounding at least one of the electrodes, said shield being tubular in shape, wherein an inner circumference d, of the electrode shield meets the relation:

$$1.25\times d_e \leqq d_s \leqq 2.5\times d_e,$$

wherein $d_e$ represents an outer circumference of the electrode.

2. A lamp comprising:

a discharge vessel which encloses a discharge space containing a filling of mercury and an inert gas in a gastight manner;

electrodes being arranged in the discharge space for generating and maintaining a discharge in said discharge space; and an electrode shield at least substantially surrounding at least one of the electrodes, said electrode shield being tubular in shape and being along an axis of said at least one of the electrodes, wherein an inner circumference $d_s$ of the electrode shield meets the relation:

$$1.25\times d_e \leqq d_s \leqq 2.5\times d_e,$$

wherein $d_e$ represents an outer circumference of the electrode.

* * * * *